US006660970B1

(12) United States Patent
Geissinger et al.

(10) Patent No.: US 6,660,970 B1
(45) Date of Patent: Dec. 9, 2003

(54) CERAMIC SHEATHED ELEMENT GLOW PLUG

(75) Inventors: Albrecht Geissinger, Muehlacker (DE); Gert Lindemann, Lichtenstein (DE); Christoph Haluschka, Klingenberg (DE); Andreas Reissner, Stuttgart (DE); Wolfgang Dressler, Vaihingen/Enz (DE); Friederike Lindner, Gerlingen (DE); Wolfgang Otterbach, Stuttgart (DE); Christoph Kern, Aspach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/069,898

(22) PCT Filed: Jul. 25, 2000

(86) PCT No.: PCT/DE00/02418

§ 371 (c)(1),
(2), (4) Date: Jun. 27, 2002

(87) PCT Pub. No.: WO01/16528

PCT Pub. Date: Mar. 8, 2001

(30) Foreign Application Priority Data

Aug. 27, 1999 (DE) ..... 199 40 668
Apr. 26, 2000 (DE) ..... 100 20 329

(51) Int. Cl.[7] ..... F23Q 7/22

(52) U.S. Cl. ..... 219/270; 361/266; 219/543; 123/145 A; 313/141

(58) Field of Search ..... 219/270, 544, 219/543, 553; 361/264, 265, 266; 123/145 A, 145 R, 143 C; 313/118, 141, 142

(56) References Cited

U.S. PATENT DOCUMENTS 4,449,039 A * 5/1984 Fukazawa et al. ..... 219/553
4,682,008 A 7/1987 Masaka
4,733,053 A * 3/1988 Mueller ..... 219/270
5,091,631 A * 2/1992 Dupuis et al. ..... 219/270
5,093,555 A * 3/1992 Dupuis et al. ..... 219/270
5,172,664 A * 12/1992 Mueller et al. ..... 123/145 A
5,750,958 A * 5/1998 Okuda et al. ..... 123/145 A
5,834,736 A * 11/1998 Kawamura ..... 219/270
6,046,434 A * 4/2000 Locher et al. ..... 219/270
6,049,065 A * 4/2000 Konishi ..... 219/270
6,320,167 B1 * 11/2001 Lindemann et al. ..... 219/553

FOREIGN PATENT DOCUMENTS

| | | |
|---|---|---|
| DE | 29 37 884 | 4/1981 |
| DE | 40 28 859 | 4/1991 |
| DE | 198 44 347 | 3/2000 |
| WO | WO 95 22722 | 8/1995 |

OTHER PUBLICATIONS

Patent Abstracts of Japan vol. 013, No. 130, (M–808), Mar. 30, 1989 & JP 63 297924 A (Jidosha Kiki Co LTD; Others: 01), Dec. 5, 1988 abstract*.

* cited by examiner

*Primary Examiner*—R. Mayer
*Assistant Examiner*—Fadi H. Dahbour
(74) *Attorney, Agent, or Firm*—Kenyon & Kenyon

(57) ABSTRACT

A ceramic sheathed-type glow plug, whose ceramic heating element is made of an electrically conductive conducting layer and an electrically insulating layer, is described. The conducting layer is made of lead layers and a heating layer. The higher specific electrical resistance of the heating layer allows the temperature of the heating layer and the combustion chamber to be determined. The electrical contact between a connector element and the heating element is established by a contacting element, which is in the form of a pellet made of an electrically conductive powder.

12 Claims, 4 Drawing Sheets

CERAMIC SHEATHED ELEMENT GLOW PLUG

FIELD OF THE INVENTION

The present invention relates to a ceramic sheathed-type glow plug for diesel engines.

BACKGROUND INFORMATION

Sheathed-type glow plugs having an external ceramic heater are described, for example, in German Patent Application No. 40 28 859. In addition, metallic sheathed-type glow plugs, in which the coiled metallic filament is welded to a thermocouple, are described in, e.g. German Patent Application No. 29 37 884. In this case, the temperature in a specific cylinder may be measured during the operation of the sheathed-type glow plug by recording the thermoelectric voltage. However, a coiled metallic filament is not present in a sheathed-type glow plug having a ceramic heating element.

In addition, a sheathed-type glow plug, which has a connector element that is electrically connected to the heating element by a contacting element, is described in German Patent Application No. 198 44 347. As is evident from FIG. 1, this contacting element is designed as a spring.

SUMMARY OF THE INVENTION

In accordance with an exemplary embodiment of the present invention, the ceramic sheathed-type glow plug may have the advantage that the temperature of the heating element is measurable. In a ceramic sheathed-type glow plug, it may be possible, for the first time, to directly measure the temperature of the heating element in a selected region on the outside of the heating element, without any additional equipment. The temperature is measured in a selected region, which is small in comparison with the volume of the entire heating element. This means that the error occurring on account of a temperature distribution over a large volume may be reduced during the temperature determination. In addition, it may be advantageous that, in the sheathed-type glow plug of the present invention, the heating power may be concentrated in a selected region of the heating element without changing the cross-section of the conductive layer, so that the surface region where the heating power may be concentrated remains constant, and therefore, the surface of interaction may also be held constant. It may be further advantageous that such a ceramic, temperature-measuring, sheathed-type glow plug may be manufactured inexpensively.

Exemplary embodiments of the present invention may allow advantageous further refinements and improvements of the ceramic, sheathed-type glow plug. In particular, a suitable selection of the ceramic materials used for the different regions of the sheathed-type glow plug ensures that the mechanical stability of the heater is not significantly affected. The processing of the measured temperature values by a control unit allows the temperature to be controlled in the selected region of the heating element. Furthermore, it may be advantageous to use the sheathed-type glow plug of the present invention as a temperature sensor in passive operation, after it has fulfilled the heating function. Thus, it may be determined if the combustion in the specific cylinder is proceeding properly. It may be advantageous to control parameters relevant for the combustion, based on this information.

In comparison with the related art, the ceramic, sheathed-type glow plug according to one exemplary embodiment of the present invention may have the advantage that, because of the larger cross-section of the line, larger currents may be carried without thermally destroying the material of the contacting element. The high surface area of the contacting material may also be advantageous, since it may allow a good thermal conductivity. The elastic spring portion ensures that thermal displacements of the surrounding component parts, which are caused by different coefficients of thermal expansion, may be compensated for.

Further refinements and improvements of the ceramic, sheathed-type glow plug may be possible. For example, it may be advantageous for the contacting element to be made of graphite or a conductive ceramic powder, since these materials are corrosion-resistant. In addition, it may advantageous for just a predominant portion of the material to be graphite or a conductive ceramic or metal powder, since it may be possible to reduce the amount of expensive materials and obtain roughly the same properties. Furthermore, it may be advantageous to manufacture the sheathed-type glow plug having a contacting element according to the present invention in the manner described below, since the result is a configuration of the components in the plug housing which may prevent short circuits. Furthermore, the components may be compressed in such a manner that, on one hand, the components do not loosen and, on the other hand, the components do not burst due to the counteracting force of elastic elements (e.g. of the contacting element) being too large.

DETAILED DESCRIPTION

Figure 1:
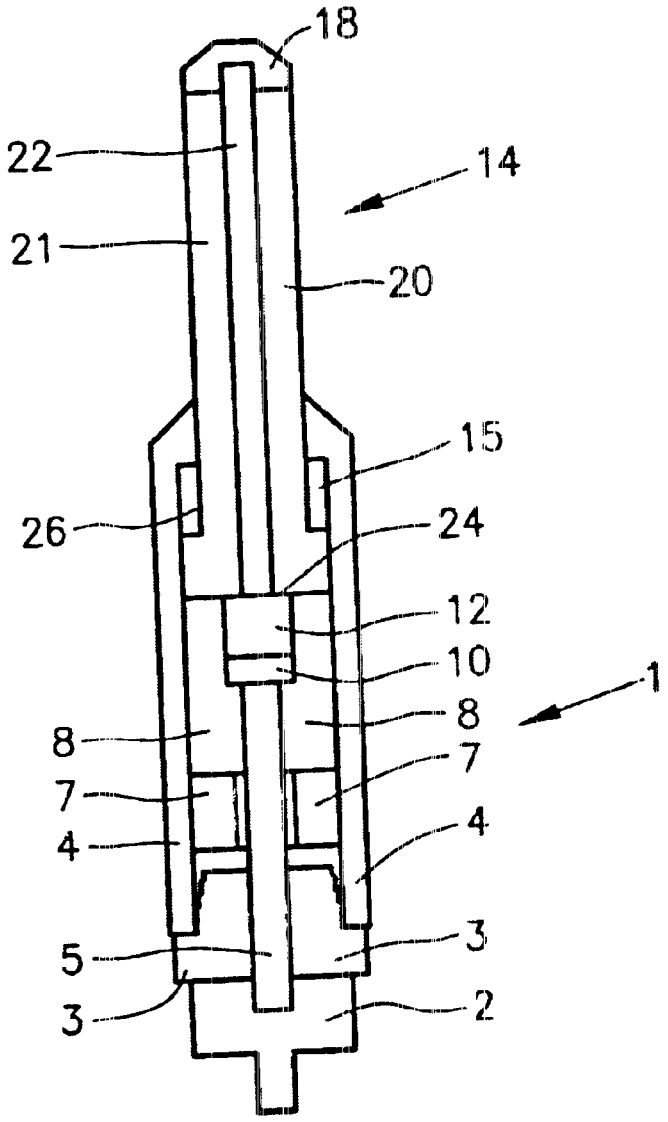
FIG. 1 shows a longitudinal cross-section of a sheathed-type glow plug according to an exemplary embodiment of the present invention.

FIG. 1 shows a schematic longitudinal cross section of a ceramic, sheathed-type glow plug 1 according to one exemplary embodiment of the present invention. On the side of sheathed-type glow plug 1 away from the combustion chamber, the electrical contact is made by a circular plug 2, which is separated from plug housing 4 by a seal 3 and is connected to cylindrical lead 5. Cylindrical lead 5 is fixed in position in plug housing 4 by a metal ring 7 and an electrically insulating, ceramic sleeve 8. Cylindrical lead 5 is connected to ceramic heating element 14 via a contact pin 10 and a suitable contacting element 12. Cylindrical lead 5 is also combinable with contact pin 10 into one component part. The contacting element, for example, may take the form of a contact spring or an electrically conductive powder packing or an electrically conductive pellet having an elastic spring portion that may be made of graphite. The interior of the heating element is sealed from the combustion chamber by packing 15. Packing 15 may be, for example, made of an electrically conductive carbon compound.

However, packing 15 may also be made of metals, a mixture of carbon and metal, or a mixture of ceramic and metal. Heating element 14 is made of a ceramic heating layer 18 and ceramic lead layers 20 and 21, the two lead layers 20, 21 being connected by heating layer 18 and forming, together with heating layer 18, the conducting layer. Lead layers 20, 21 have an arbitrary shape. Heating layer 18 may also have an arbitrary shape. The conducting layer may be, for example, U-shaped. Lead layers 20 and 21 are separated by an insulating layer 22, which may also be made of ceramic material. In the exemplary embodiment represented in FIG. 1, heating element 14 is designed to have lead layers 20 and 21, as well as heating layer 18, externally positioned on heating element 14. However, it may also be possible for at least lead layers 20, 21 to be situated inside the heating element and covered by an external, ceramic insulating layer. Inside the plug housing, the ceramic heating element is insulated from the remaining components of the sheathed-type glow plug 4, 8, 12, 15 by a glass layer not shown. The glass layer is interrupted at position 24 in order to produce the electrical contact between contacting element 12 and lead layer 20. The glass layer is also interrupted at position 26 in order for an electrical contact to be established between lead layer 21 and plug housing 4 via packing 15. In this exemplary embodiment, the heating layer 18 is placed at the tip of the heating element. However, this heating layer may also be placed at another position of the conducting layer. Heating layer 18 may be situated at the position where the greatest heating effect may be achieved.

Figure 2:
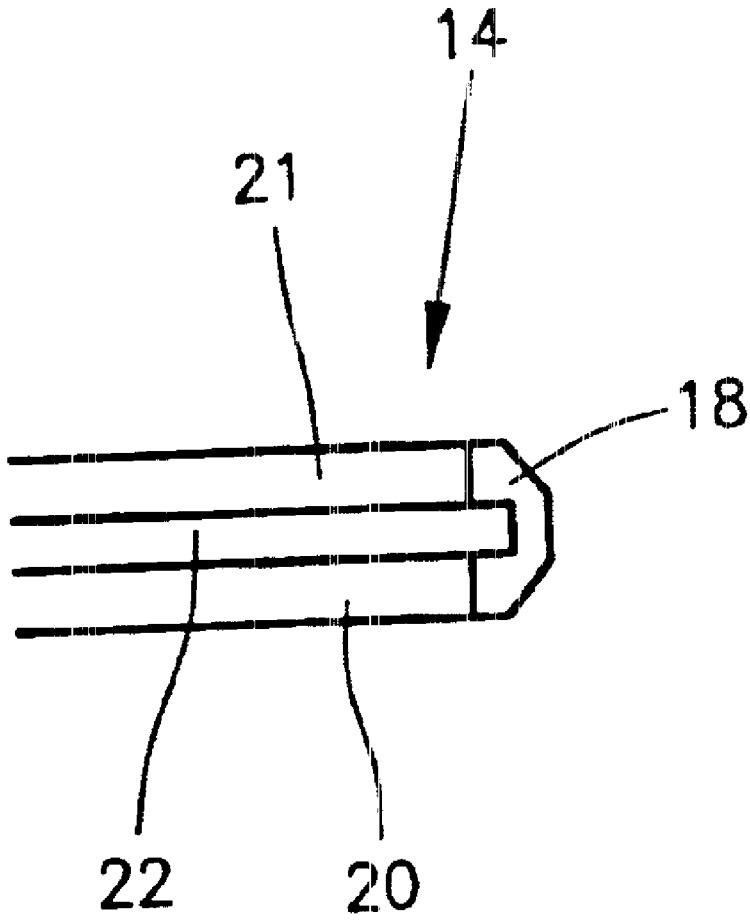
FIG. 2 shows a side view of the front section of the external ceramic heater of FIG. 1.

A side view of the ceramic heating element is shown in FIG. 2. As is the case in FIG. 1, the example embodiment in which heating layer 18 is situated at the tip of the heating element is represented. In addition, lead layers 20, 21 and insulating layer 22 may be seen. This side view shows the conducting layer as made up of lead layers 20 and 21 and heating layer 18 as U-shaped.

The operating state in which the heating element is heated in order to support the combustion in the combustion chamber is called active operation. This heating occurrs when the internal combustion engine is started, during a post-heating phase which may, for example, extend beyond 3 minutes, as well as during an intermediate heating phase when the temperature of the combustion chamber drops too sharply during the operation of the engine.

In the ceramic, sheathed-type glow plug of the present invention, the material of heating layer 18 may be chosen so that the absolute electrical resistance of heating layer 18 is greater than the absolute electrical resistance of lead layers 20, 21. (In the following, the expression, resistance, is to be understood as not including the absolute electrical resistance.) In order to prevent cross-currents across the conducting layer, the resistance of the insulating layer may be chosen to be markedly greater than the resistance of heating layer 18 and lead layers 20, 21.

Figure 3:
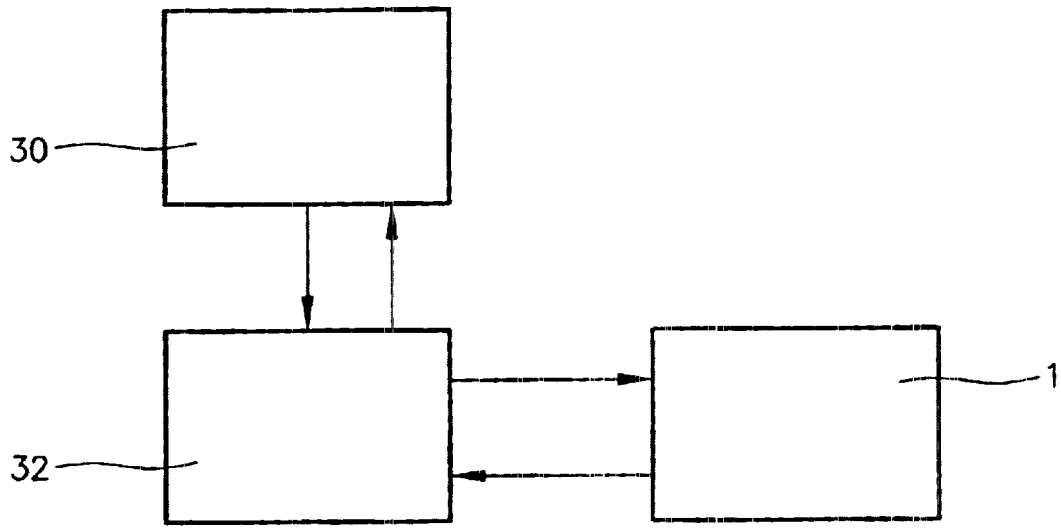
FIG. 3 shows the interconnection of the sheathed-type glow plug of the present invention and the control units.

FIG. 3 is a schematic representation of the devices that communicate with sheathed-type glow plug 1. The first of these is engine control unit 30, which includes a computational unit and a storage unit. The engine-dependent parameters of the sheathed-type glow plug are stored in engine control unit 30. These may include the resistance-temperature characteristic maps as a function of load and speed of the engine. The memory of the engine control unit also includes one or more reference temperature values for correct combustion. The engine control unit may control parameters that influence combustion, such as the injection period, the start of fuel injection, and the end of fuel injection. Control unit 32 controls a voltage, which is selected by the engine control unit. This voltage represents the total voltage used for the sheathed-type glow plug. In addition, control unit 32 houses a current-measuring device, which measures the amperage flowing through the heating element. Control unit 32 also includes a storage unit and a processing unit. Engine control unit 30 and control unit 32 may also be combined into one device.

Figure 4:
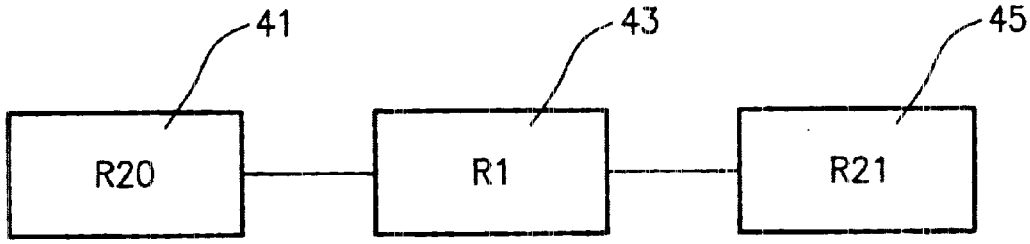
FIG. 4 shows the resistances occurring in the sheathed-type glow plug of the present invention, and in the leads.

FIG. 4 illustrates the resistances occurring across the sheathed-type glow plug. Resistance 41, having a value of R20, is the resistance of ceramic lead layer 20. Resistance 43, having a value of R1, includes the resistance of the heating layer. Resistance 45, having a value of R21, includes the resistance of ceramic lead layer 21. Added to these are the resistances of the remaining leads and return lines, which, however, are small in comparison with resistances R20 and R21 and are therefore not considered. They are not drawn into FIG. 4. Resistances 41, 43, and 45 are connected in series. Any occurring cross-currents shall be neglected in the observations made in view of FIG. 4. Therefore, total resistance R is obtained from the sum of resistances R20, R1, and R21. In this case, resistance R1 constitutes the largest addend.

Using the characteristic maps contained in it and the desired temperature of the heating element, engine control unit 30 selects an effective voltage which is controlled by control unit 32. Based on the temperature dependence of resistors 41, 43, and 45, a current I, which is measured in control unit 32, travels through the sheathed-type glow plug, i.e., through resistor R. In this context, the temperature dependence of total resistance R=R20+R1+R21 mainly results from the temperature dependence of resistance R1, since this resistance has the greatest value. The temperature dependence of resistances R20, R1, and R21 is nearly constant over the entire operating range of the sheathed-type glow plug, between room temperature and a temperature of approximately 1400° C. The temperature of the combustion chamber is in the operating range of the sheathed-type glow plug.

Using a stored characteristics map, measured amperage I is converted by control unit 32 to a temperature, which is mainly derived from the temperature of heating layer 18, because resistance R1 is markedly greater than resistances R20 and R21. This temperature is transmitted back to engine control unit 30, the effective voltage for the sheathed-type glow plug being selected anew, based on the ascertained temperature.

It may also be possible to output the temperature elsewhere, e.g., on a display. In addition, it may be possible to draw conclusions about the quality of combustion in a cylinder-specific manner, by using the ascertained temperature and considering, for example, one or more reference temperatures stored in engine control unit 30. In the case of improper combustion, the control unit may take cylinder-specific measures, which influence the combustion process and may thus ensure proper combustion again. For example, the injection period, the start of injection, or the injection pressure of the fuel may be varied.

In a further exemplary embodiment, it may also be possible to measure the temperature of the combustion chamber in the passive operation of the sheathed-type glow plug, i.e., after the post-heating time, when the sheathed-type glow plug is no longer in active operation. In this case, a correspondingly lower, effective voltage is selected, and, in a manner analogous to active operation, current I flowing through resistor R is measured, and the temperature of the heating region, which then corresponds to the temperature of the combustion chamber, is thus deduced. Just as in active operation, the temperature of the combustion chamber may be compared, in a cylinder-specific manner, to one or more reference values for proper combustion stored in the engine control unit. If the temperature of the combustion chamber does not correspond to proper combustion, measures may be taken, which again provide for proper combustion, such as varying the injection period, the start of injection, and the injection pressure of the fuel.

The value of resistances R20, R1, and R21, as well as their temperature dependence, may be determined by $$R=?*1/A,$$

and by the temperature dependence of specific resistance?, 1 representing the length of the resistor and A representing the cross-sectional area. In this context, the temperature dependence may be revealed by $$?(T)=?_0(T_0)*(1+?(T)*(T-T_0).$$

?(T) denotes the specific resistance as a function of temperature T, $?_0$ denotes the specific resistance at room temperature $T_0$, and ?(T) is a temperature-dependent temperature coefficient.

In order to obtain a temperature dependence of lead resistances R20 and R21, which is different from that of resistance R1, the specific resistance of heating layer 18 may be chosen so that $?_0$ of the heating layer is greater than $?_0$ of the lead layers. Or else, temperature coefficient ? of heating layer 18 may be greater than the temperature coefficient ? of lead layers 20, 21 in the operating range of the sheathed-type glow plug. It may also be possible to select both $?_0$ and ? for heating layer 18 to be greater than those for lead layers 20, 21, in the operating range of the sheathed-type glow plug.

In an exemplary embodiment, the composition of heating layer 18 and lead layers 20, 21 is selected such that $?_0$ of lead layers 20, 21 is at least 10 times smaller than $?_0$ of heating layer 18. Temperature coefficients ? of heating layer 18 and lead layers 20, 21 are approximately equal. Consequently, an accuracy of 20 Kelvin may be achieved for the temperature measurement in the entire operating range of the sheathed-type glow plug.

In an exemplary embodiment, the specific resistance of insulating layer 22 is at least 10 times greater than the specific resistance of heating layer 18 in the entire operating range of the sheathed-type glow plug.

An exemplary embodiment provides for the heating layer, the lead layers, and the insulating layer being made of ceramic composite matrices (composites), which contain at least two of the compounds $Al_2O_3$, $MoSi_2$, $Si_3N_4$, and $Y_2O_3$. These composites are obtainable using a one-step or multi-step sintering process. In this context, the specific resistance of the layers may be determined by the $MoSi_2$ content and/or the grain size of $MoSi_2$. The $MoSi_2$ content of lead layers 20, 21 may be, for example, greater than the $MoSi_2$ content of heating layer 18, heating layer 18 having, in turn, a higher $MoSi_2$ content than insulating layer 22.

In a further exemplary embodiment, heating layer 18, lead layers 20, 21, and insulating layer 22 are made of a composite precursor ceramic having various proportions of fillers. In this context, the matrix of this material is made of polysiloxanes, polysilsesquioxanes, polysilanes, or polysilazanes that may be doped with boron or aluminum and are produced by pyrolysis. At least one of the compounds $Al_2O_3$, $MoSi_2$, and SiC forms the filler for the individual layers. Analogously to the above-mentioned composite, the $MoSi_2$ content and/or the grain size of the $MoSi_2$ may, for example, determine the specific resistance of the layers. The $MoSi_2$ content of lead layers 20, 21 may be set higher than the $MoSi_2$ content of heating layer 18, heating layer 18 having, in turn, a higher $MoSi_2$ content than insulating layer 22.

In the above-described exemplary embodiments, the compositions of the insulating layer, the lead layers, and the heating layer are selected such that their thermal expansion coefficients and the shrinkages of the individual lead layers, heating layers, and insulating layers occurring during the sintering and pyrolysis processes are equal, so that no cracks are formed in the sheathed-element glow plug.

Figure 5:
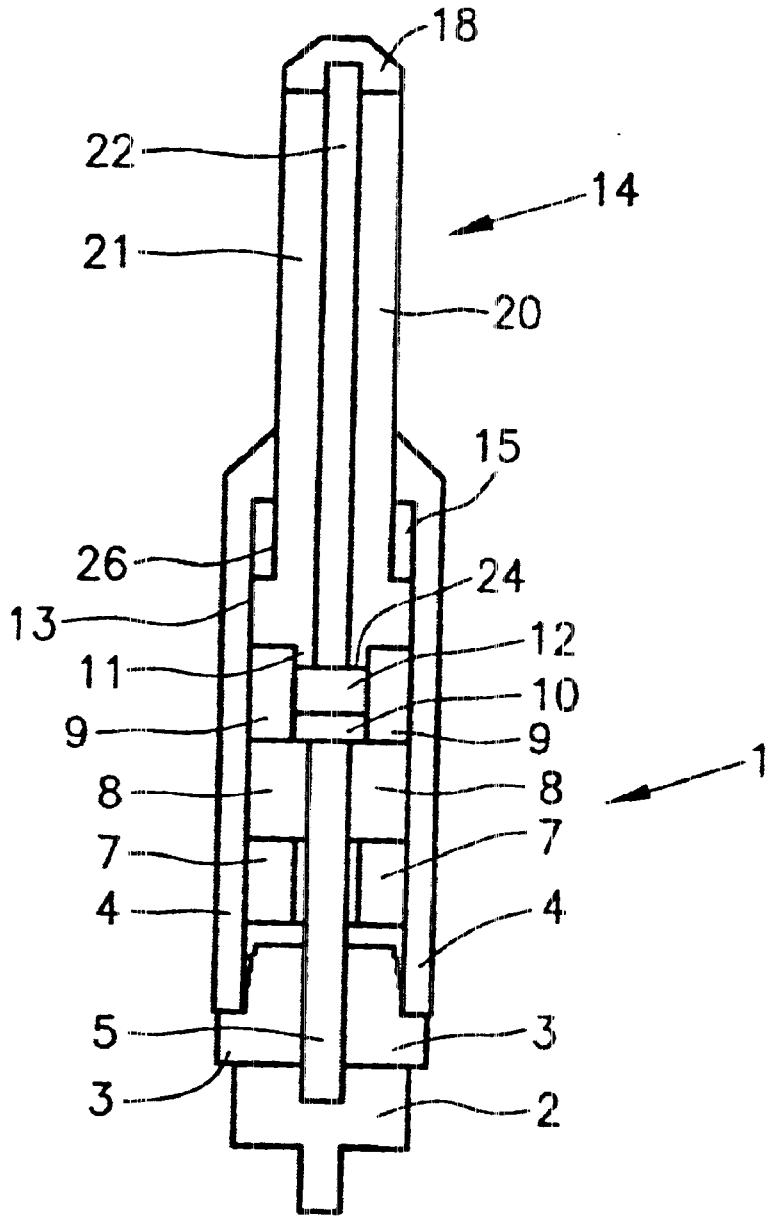
FIG. 5 shows a longitudinal cross-section of a sheathed-type glow plug according to an exemplary embodiment of the present invention.

In FIG. 5, a further exemplary embodiment of the present invention is represented with the aid of a schematic longitudinal cross-section of a sheathed-type glow plug 1 according to the present invention. In this context, identical reference numerals used in the above-mentioned figures denote the same component parts, which will not be explained here again. The sheathed-element glow plug represented in FIG. 5 has, analogously to FIG. 1, a circular plug 2 that is in electrical contact with cylindrical lead 5. Cylindrical lead 5 is electrically connected to ceramic heating element 14 via contact pin 10 and contacting element 12. As shown in FIG. 5, cylindrical lead 5, contact pin 10, contacting element 12, and ceramic heating element 14 are arranged one behind the other, in this order, in the direction of the combustion chamber. In the example embodiment represented in FIG. 5, ceramic heating element 14 has a peg 11 on the end away from the combustion chamber. Peg 11 constitutes an elongation of heating element 14 in the direction of the end away from the combustion chamber, formed by a cylindrical extension of ceramic lead layers 20, 21 and insulating layer 22 outward, peg 11 having a smaller outer diameter than the section of heating element 14 contiguous to the peg in the direction of the combustion chamber, i.e., collar 13. Furthermore, it may not be necessary for heating element 14 to have a heating layer 18 on the combustion-chamber end. In an exemplary embodiment, the two lead layers 20, 21 may simply be connected at the combustion-chamber end of the heating element, as is accomplished via heating element 18.

Cylindrical lead 5 and contact pin 10 together form the connector element, which may also be formed in one piece. Provided at the combustion-chamber end of the connector element is a flange, which, together with peg 11, borders contacting element 12 in the direction of the axis of the sheathed-type glow plug.

Contacting element 12, which is made of a pellet of. electrically conductive powder, may be in the form of graphite or a metal powder or an electrically conductive, ceramic powder. In a further, exemplary embodiment, it may also be possible for at least a predominant portion of the pellet made of electrically conductive powder to include graphite or the metal powder or the electrically conductive, ceramic powder. Because contacting element 12 is in the form of electrically conductive powder, contacting element 12 ensures a flexible contact that is able to carry high currents without being thermally destroyed. The high surface area of the powder ensures a high thermal conductivity. A low contact resistance with good electrical conductivity may also be achieved for the same reason. In addition, graphite and ceramic conductive materials are resistant to corrosion. The elastic spring portion of the pellet made of electrically conductive powder ensures that the pellet compensates for thermal movements of the component parts caused by different coefficients of thermal expansion.

The pellet made of electrically conductive powder is bounded on the side by a cylindrical tension sleeve 9, which is present here in the form of an independent component part, in place of the ceramic sleeve 8 represented in FIG. 1. Tension sleeve 9 is provided as an insulating component part in a manner analogous to ceramic sleeve 8. In an exemplary embodiment, the tension sleeve is made of a ceramic material. During the manufacture of the sheathed-type glow plug, the pellet made of electrically conductive powder is firmly compressed between the flange of the connector element on the end face away from the combustion chamber, between peg 11 of heating element 14 on the end face on the side of the combustion chamber, and between tension sleeve 9. The clamping between these fixed component parts, in particular the fixed contact of tension sleeve 9 with ceramic sleeve 8, i.e. the limited pressing height prevents surrounding tension sleeve 9 from rupturing due to the internal pressure built up from the compression of contacting element 12 being too high. The axial prestressing of the elastic spring portion caused by the clamping of the pellet made of electrically conductive powder allows thermal expansion, settling behavior, and vibrational stress of the sheathed-type glow plug in response to shaking loads, to be compensated for.

A sheathed-type glow plug according to FIG. 5, which has a pellet made of electrically conductive powder as a contacting element 12, may be manufactured as follows. Packing 15 is initially guided over ceramic heating element 14 from the combustion-chamber-side tip of ceramic heating element 14, and inserted into plug housing 4 as a composite, from the end away from the combustion chamber. Contacting element 12, tensioning sleeve 9, connector element 5, 10, ceramic sleeve 8, and metal ring 7 are then positioned in a retaining element and subsequently inserted into plug housing 4 from the end away from the combustion chamber, as well. Then, the components in the plug housing are compressed, using an axial force that is applied to the end of metal ring 7 away from the combustion chamber. In particular, contacting element 12, which is in the form of a pellet made of electrically conductive powder, and packing 15 are compressed. In so doing, a force is only applied to contacting element 12 until contact pin 10 of connector element 5, 10 has been completely pressed into tension sleeve 9, and the end face of ceramic sleeve 8 rests on the end face of tension sleeve 9. In addition, the compression of the pellet made of electrically conductive powder ensures that the elastic spring portion of the pellet is prestressed. Metal ring 7 is then crimped, using an external force applied radially to plug housing 4. Afterwards, seal 3 and circular plug 2 are assembled and crimped, using an external force applied radially to plug housing 4, as well.

What is claimed is:

1. A sheathed-type glow plug, comprising:

a ceramic heating element having a ceramic, electrically conductive conducting layer and a ceramic insulating layer, the conducting layer made of lead layers connected by a heating layer, the heating layer having a specific electrical resistance as a function of a temperature within an operating range of the sheath-type glow plug, the specific electrical resistance of the heating layer being greater than a specific electrical resistance of the lead layers and less than a specific electrical resistance of the insulating layer;

wherein a temperature coefficient of the lead layers is less than a temperature coefficient of the heating layer over an entire operating range of the sheathed-type glow plug.

2. A sheathed-type glow plug, comprising:

a ceramic heating element having a ceramic, electrically conductive conducting layer and a ceramic insulating layer, the conducting layer made of lead layers connected by a heating layer, the heating layer having a specific electrical resistance as a function of a temperature within an operating range of the sheath-type glow plug, the specific electrical resistance of the heating layer being greater than a specific electrical resistance of the lead layers and less than a specific electrical resistance of the insulating layer, wherein the specific electrical resistance at a room temperature and a temperature coefficient of the lead layers is less than the specific electrical resistance at the room temperature and a temperature coefficient of the heating layer.

3. A sheathed-type glow plug, comprising:

a ceramic heating element having a ceramic, electrically conductive conducting layer and a ceramic insulating layer, the conducting layer made of lead layers connected by a heating layer, the heating layer having a specific electrical resistance as a function of a temperature within an operating range of the sheath-type glow plug, the specific electrical resistance of the heating layer being greater than a specific electrical resistance of the lead layers and less than a specific electrical resistance of the insulating layer;

wherein the specific electrical resistance of the heating layer at a room temperature is at least 10 times greater than a larger of specific electrical resistances of the lead layers at the room temperature.

4. A sheathed-type glow plug, comprising:

a ceramic heating element having a ceramic, electrically conductive conducting layer and a ceramic insulating layer, the conducting layer made of lead layers connected by a heating layer, the heating layer having a specific electrical resistance as a function of a temperature within an operating range of the sheath-type glow plug, the specific electrical resistance of the heating layer being greater than a specific electrical resistance of the lead layers and less than a specific electrical resistance of the insulating layer;

wherein the heating layer is at a tip of the heating element.

5. A sheathed-type glow plug, comprising:

a ceramic heating element having a ceramic, electrically conductive conducting layer and a ceramic insulating layer, the conducting layer made of lead layers connected by a heating layer, the heating layer having a specific electrical resistance as a function of a temperature within an operating range of the sheath-type glow plug, the specific electrical resistance of the heating layer being greater than a specific electrical resistance of the lead layers and less than a specific electrical resistance of the insulating layer;

wherein the heating layer, the lead layers, and the insulating layer are made of ceramic composite structures, which are obtainable from a plurality of compounds using one of a one-step and a multi-step sintering process, the plurality of compounds including at least two of $A1_2O_3$, $MoSi_2$, $Si_3N_4$ and $YO_3$.

6. A sheathed-type glow plug, comprising:

a ceramic heating element having a ceramic, electrically conductive conducting layer and a ceramic insulating layer, the conducting layer made of lead layers connected by a heating layer, the heating layer having a specific electrical resistance as a function of a temperature within an operating range of the sheath-type glow plug, the specific electrical resistance of the heating layer being greater than a specific electrical resistance of the lead layers and less than a specific electrical resistance of the insulating layer;

wherein the heating layer, the lead layers, and the insulating layer are made of a composite precursor ceramic having a matrix material including at least one of polysiloxanes, polysilsesquioxanes, polysilanes, and polysilazanes, which were produced by pyrolysis, the composite precursor ceramic including a filler formed from at least one of $A1_2O_3$, $MoSi_2$, and SiC.

7. The sheathed-type glow plug according to claim 6, wherein the matrix material is doped with one of boron and aluminum.

8. A sheathed-type glow plug, comprising:

a ceramic heating element having a ceramic, electrically conductive conducting layer and a ceramic insulating layer, the conducting layer made of lead layers connected by a heating layer, the heating layer having a specific electrical resistance as a function of a temperature within an operating range of the sheath-type glow plug, the specific electrical resistance of the heating layer being greater than a specific electrical resistance of the lead layers and less than a specific electrical resistance of the insulating layer;

wherein a temperature value of the heating layer is determined using the specific electrical resistance of the heating layer.

9. The sheathed-type glow plug according to claim 8, wherein the determined temperature value is passed on to an engine control unit configured to compare the determined temperature value to a reference value and to correct a voltage selected for the sheathed-type glow plug by a second control unit.

10. The sheathed-type glow plug according to claim 8, wherein the determined temperature value is passed on to an engine control unit configured to compare the determined temperature value to at least one reference value for proper combustion and to correct variables relevant to combustion.

11. The sheathed-type glow plug according to claim 10, wherein the temperature determination, the comparison to at least one reference value for proper combustion, and the correction of variables relevant to combustion occur in a passive operation of the sheathed-type glow plug.

12. The sheathed-type glow plug according to claim 10, wherein the parameters relevant to combustion include an injection period, a start of injection, and an injection pressure of the fuel.

* * * * *